US005590435A

United States Patent [19]

Kostigian

[11] Patent Number: 5,590,435

[45] Date of Patent: Jan. 7, 1997

[54] FLOOR COVERING STORAGE RACK WITH CLEANING DEVICE

[75] Inventor: John V. Kostigian, Cambridge, Canada

[73] Assignee: Galt Display Rack Company Limited, Cambridge, Canada

[21] Appl. No.: 489,374

[22] Filed: Jun. 12, 1995

[30] Foreign Application Priority Data

Mar. 24, 1995 [CA] Canada ..... 2145438

[51] Int. Cl.[6] ..... A47F 7/17; A47L 13/50

[52] U.S. Cl. ..... 15/40; 15/88.1; 15/268; 211/44

[58] Field of Search ..... 15/40, 41.1, 42, 15/47, 256.5, 268, 77, 88.1; 211/44, 175, 198; 242/388.5, 388.7, 388.6, 398, 419, 539, 548, 594, 615.4

[56] References Cited

U.S. PATENT DOCUMENTS

| | | | |
|---|---|---|---|
| 1,115,190 | 10/1914 | Harris et al. | 15/268 |
| 1,270,709 | 6/1918 | Darling | 242/539 |
| 4,280,672 | 7/1981 | Santos et al. | 15/40 |
| 5,013,367 | 5/1991 | Butts | 15/40 |
| 5,222,680 | 6/1993 | Barcombe et al. | 242/548 |
| 5,361,444 | 11/1994 | Theilemann | 15/256.5 |

FOREIGN PATENT DOCUMENTS

| | | | |
|---|---|---|---|
| 4658 | 1/1901 | Austria | 15/268 |
| 1090312 | 11/1980 | Canada . | |
| 1304734 | 7/1992 | Canada . | |
| 302956 | 2/1989 | European Pat. Off. | 15/256.5 |
| 243945 | 2/1912 | Germany | 15/268 |
| 388552 | 6/1965 | Switzerland | 15/268 |
| 19168 | of 1912 | United Kingdom | 15/268 |

*Primary Examiner*—David Scherbel
*Assistant Examiner*—Tony G. Soohoo
*Attorney, Agent, or Firm*—Robert G. Hendry

[57] ABSTRACT

The present invention relates to a floor covering storage and dispensing rack including a frame equipped with castors. Upper frame members of the rack support rollers in parallel spaced relation, and a crank or motor is provided to rotate the rollers to wind the floor covering onto the rollers for storage. An elongated cleaning head or pair of brushes is provided on a frame member so that the floor covering passes over at least one cleaning head or brush when the floor covering is retrieved or dispensed to remove dirt prior to storage or reuse.

5 Claims, 4 Drawing Sheets

FLOOR COVERING STORAGE RACK WITH CLEANING DEVICE

This invention relates to floor covering storage and dispensing racks and more particularly to a rack having brushes for removing dirt as the floor covering is returned to storage.

The use of gymnasium floors for other activities such as dances and social gatherings has always caused concern that the quality of the floor will deteriorate due to street shoes being worn during activities other than sports.

It has therefore become the practice to cover gymnasium floors with sheets of thin flooring material composed of suitable synthetic material such as vinyl. The plastic covering is stored on rolls when not in use.

Floor covering racks are well known for display and dispensing purposes. The floor covering is stored on rotatable rolls on a rack and can be conveniently withdrawn and laid on the floor. The floor covering is conveniently retrieved by rotating the roller by means of a crank or an electric motor. It has now been found that in most cases it is desirable to sweep the floor covering before returning it to the storage roll.

Floor covering storing and dispensing racks available for retrieving floor covering from gymnasiums include those disclosed in Canadian Patent Nos. 1,304,734 and 1,090,312.

These prior devices did not entirely meet the requirements for a lightweight frame capable of storing ten rolls of floor covering one above the other on two sides of the frame. A broad base to avoid tipping is also desirable. Furthermore, roller bearing castors capable of being locked in position during retrieval of the floor covering had not been contemplated for known storage and display racks.

The present invention seeks to overcome the deficiencies of the prior devices by providing a floor covering dispensing storage and retrieval apparatus having a lightweight angle iron frame.

The present invention seeks to provide an apparatus having a broad base and upwardly and inwardly sloping sides to accommodate multiple rolls of floor covering, while providing stability.

The present invention further seeks to provide a floor covering dispensing and retrieval apparatus having antifriction castors adapted to be locked into place during retrieval of floor covering.

The present invention seeks to provide a floor covering retrieval and dispensing apparatus having one or more cleaning heads or brushes to remove dirt from the floor covering as it is retrieved and stored.

Accordingly, the present invention provides a floor covering storage and dispensing rack comprising: a frame, lower frame members including ground engaging means, rollers for receiving floor covering supported on the sides of the frame in parallel spaced relation, means for winding the floor covering on the rollers, an elongate cleaning head extending along a frame member parallel to the rolls, whereby material received on said rollers contacts the cleaning head as it is returned to storage on the rollers of the floor covering storage rack.

In the drawings, which illustrate embodiments of the invention:

Figure 1:
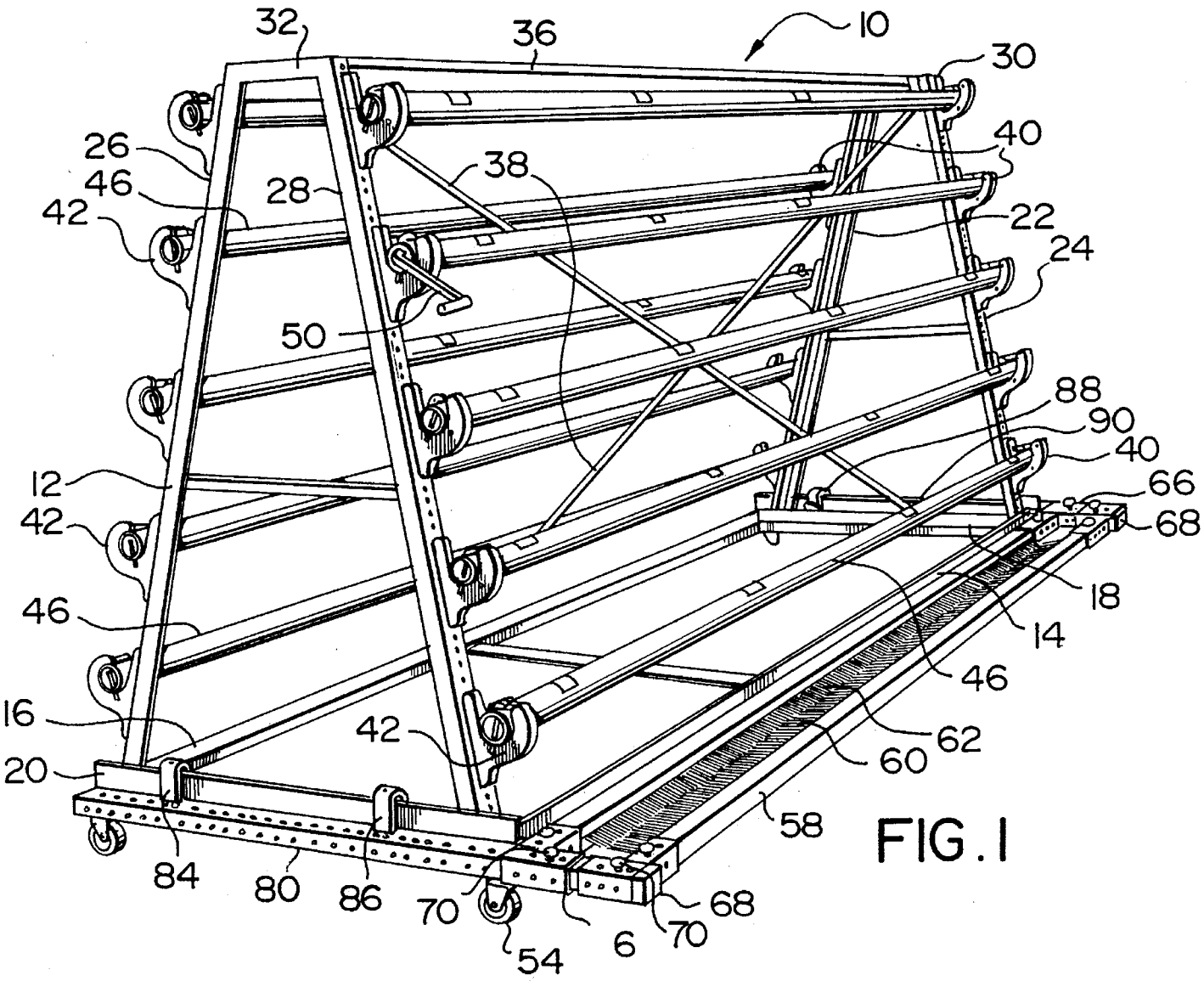
FIG. 1 is a perspective view of a floor covering storage and dispensing rack in accordance with this invention.

In the drawings, which illustrate an embodiment of the invention, the floor covering storage dispensing and retrieval rack is shown generally at 10 in FIG. 1, comprises a frame 12. The frame 12 is constructed of angle iron members to reduce weight although tubular members of circular or square cross section could also be used. The frame 12 includes a rectangular base having front and rear members 14 and 16 and interconnecting side members 18 and 20. A first upright side member includes uprights 22 and 24 secured to a side member 18 in a conventional manner such as by bolts, rivets or welding and a second upright side member includes uprights 26 and 28 secured to the opposing side member 18. Upper ends of the uprights 22 and 24 are joined by a top wall member 30 and the uprights 26 and 28 are joined by a top wall member 32. The top wall members 30 and 32 of the first and second side members are interconnected by at least one top rail 36. Diagonal braces 38 are provided on the frame.

Pairs of brackets 40 and 42 are secured to the uprights 24 and 28 to support rollers 46. The ends of the rollers 46 are adapted to receive manual cranking means 50 or electrically driven cranking means, not shown.

Figure 2:
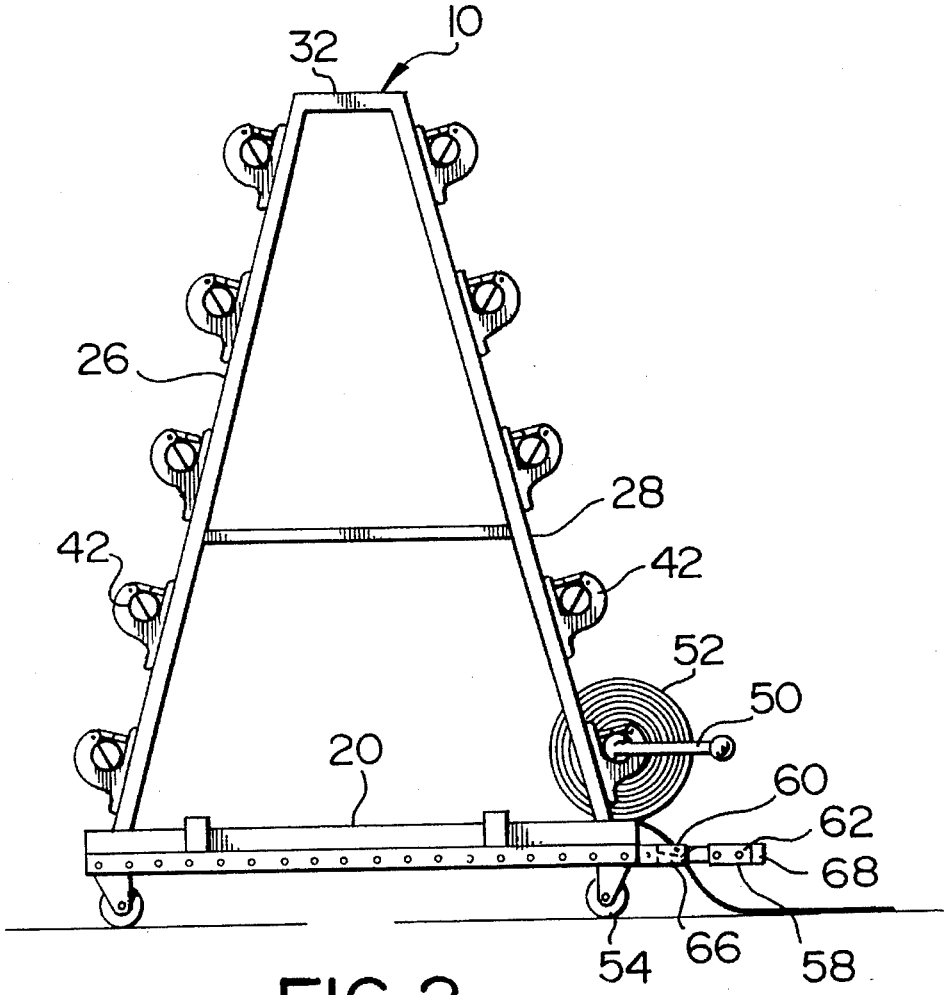
FIG. 2 is an end elevational view partly in section showing floor covering as it is returned to the storage rack.

The brackets 40 and 42 have roller bearings, not shown, to reduce friction and pins, not shown, extending through the roller 46 at the ends thereof limit axial movement of the roller with respect to their supporting brackets. The uprights 22 and 26 are also provided with pairs of brackets 40 and 42 and rollers 46. It is therefore possible to retrieve and store ten rolls of floor covering, one of which is shown at 52 in FIG. 2.

The frame 12 is supported by four rubber tired castors 54 secured to the frame 12 in a conventional manner, so that the rack 10 and floor covering 52 can be conveniently rolled from a storage location to floor covering laying or retrieving location by one or more operators.

The castors 54 are preferably provided with brakes so that during the dispensing and retrieving operation, the rack 10 will remain stationary.

Figure 3:
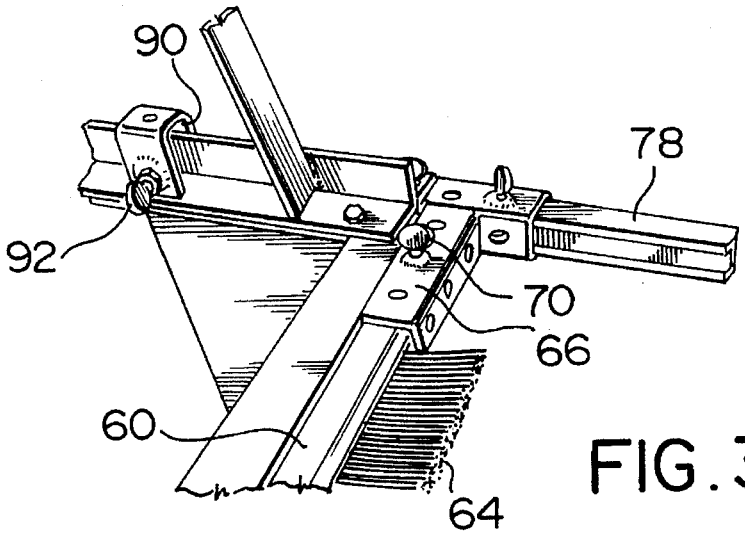
FIG. 3 is an enlarged perspective view of a floor covering brush attached to the rack.
Figure 4:
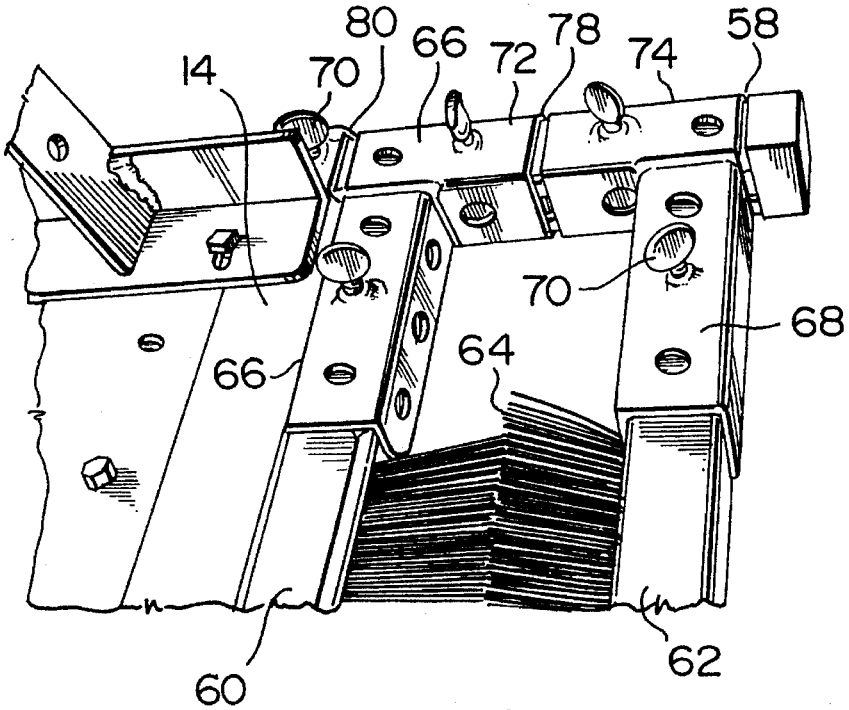
FIG. 4 is an enlarged perspective view of a second floor covering cleaning brush attached to the rack.

As shown more clearly in FIGS. 3 and 4, a cleaning head 58 comprising a pair of opposed brushes 60 and 62 extend along the frame member 14. The ends of bristles 64 of the brushes 60 and 62 extend towards each other and preferably abut or intermesh.

The brushes 60 and 62 have mounting brackets 66 and 68, respectively, at their ends. The brackets 66 and 68 are square tubular members provided with set screws 70.

The brackets 66 and 68 also have a tubular portion 72 and 74, respectively, disposed at a right angle to the brush 60 or 62 to receive rails 76 and 78.

The rails 76 and 78 are slideably received in square tubes 80 and 82 releasably secured to side rails 16 and 18 by brackets 84, 86, 88 and 90 provided with conventional set screw fasteners 92.

Figure 5:
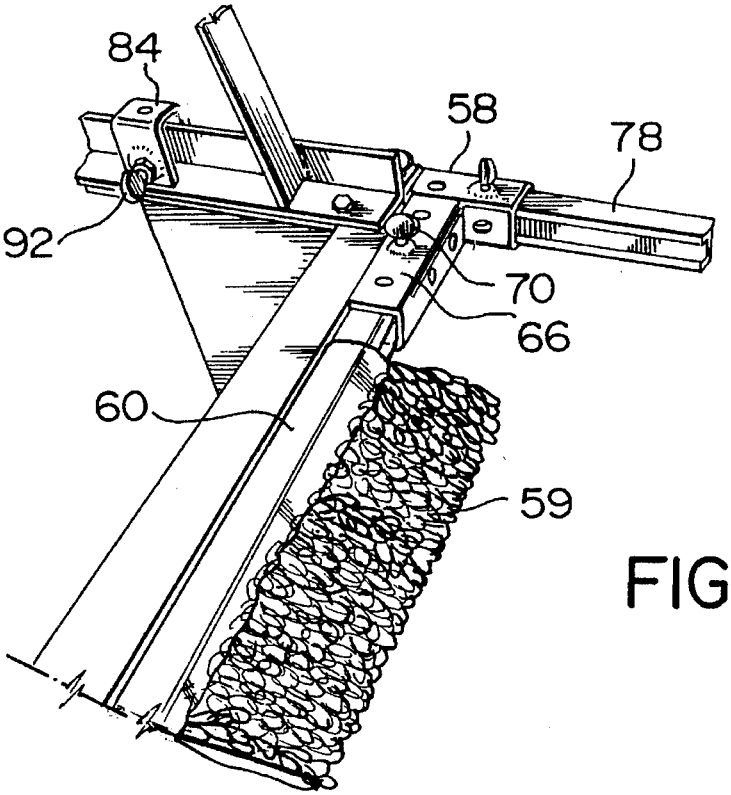
FIG. 5 is an enlarged perspective view of a cleaning head attached to the rack.

It will be appreciated that the material used in the cleaning head 58 may include loops or strands of materials suitable for mops and that the material used is not limited to bristle type brushes. The strands may be treated with tacky water soluble compounds, electrostatic sprays or the like to attract and retain dust and dirt. An example of a suitable yarn is Pro Dust Mop manufactured by HMP. Pro Dust H02 dust cleaning head treatment is recommended for use on this cleaning head material. A cleaning head of looped yarn is shown at 59 in FIG. 5.

Figure 6:
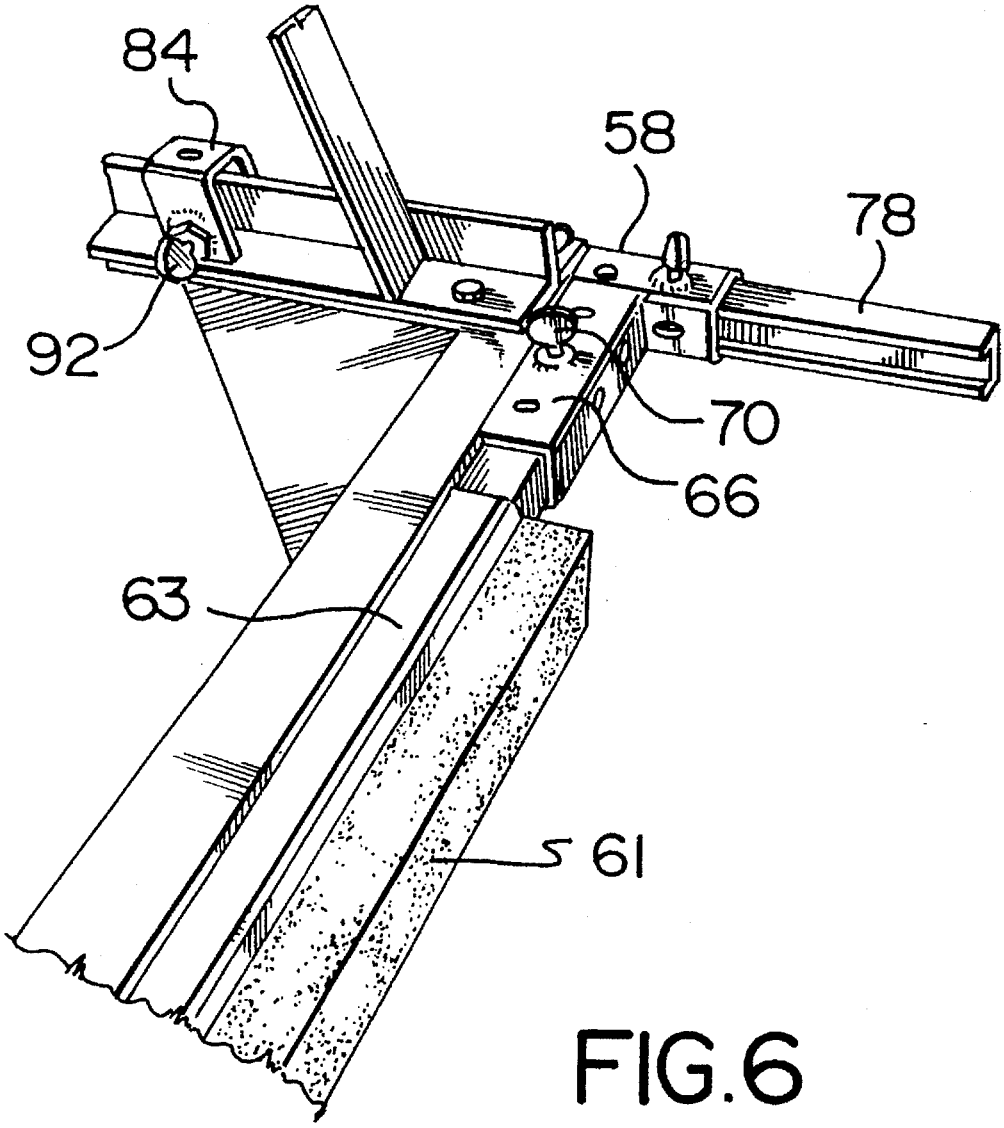
FIG. 6 is an enlarged perspective view of a cleaning sponge secured to the storage rack.

As shown in FIG. 6, the cleaning head can comprise a synthetic sponge 61 adhesively secured to a support 63. The sponge 61 is preferably formed of foamed polyether or polyurethane impregnated with a dust attractant.

In use, the rack 10 having been provided with up to 10 rolls of vinyl floor covering is moved from storage to a dispensing position. The floor covering is then unrolled from successive rollers by pulling on the floor covering while the castors are locked. The castors are unlocked to move the rack to another dispensing position. It is optional whether or not to pass the floor covering through the brushes 60 and 62 during the dispensing operation.

When the floor covering is to be retrieved, the rack 10 is positioned at one end of a strip of floor covering, so that the floor covering can be inserted through the brushes 60 and 62. Spring clips, not shown, secure the floor covering to the roller 46 as described in Canadian Patent No. 1,090,312 and the roller is rotated by means of the crank 50 or by means of an electric power drill adapted for this purpose.

The loose dirt on the upper surface of the floor covering will be swept to the end by the brush 62 and dirt on the underside will fall beneath the rack 10 and can be readily collected for disposal.

The brushes 60, 62 and the cleaning head 58 are capable of being detached and secured along the rail 16 to clean floor covering retrieved and stored on the rollers 46 on the uprights 22 and 26. The cleaning head may also be detached and moved to other storage racks 10.

After the floor covering is retrieved and cleaned, in this manner, the casters 54 are unlocked to permit moving the rack 10 to a storage area.

In use, the rack 10 having been provided with up to 10 rolls of vinyl floor covering is moved from storage to a dispensing position. The floor covering is then unrolled from successive rollers by pulling on the floor covering while the castors are locked. The castors are unlocked to move the rack 10 to another dispensing position. It is optional whether or not to pass the floor covering through the brushes 60 and 62 during the dispensing operation.

The floor covering retrieved and cleaned in this manner is then moved to a storage area after the castors have been unlocked.

The embodiments of the invention in which an exclusive property or privilege is claimed are defined as follows:

1. A rack for use in retrieving, cleaning and storing floor covering for temporarily covering a floor to be protected, said rack comprising:

a frame having a rectangular base including two side edges, a front edge, and a rear edge; and a lower frame member respectively at the front edge; and a respective first and second upright sides secured each side edge of the base, the first and second upright sides being joined at an upper end of said first and second upright sides by an top rail member; and a plurality of rollers rotatably mounted between the first and second upright sides in a vertically spaced, parallel relationship above the front and rear edges of the frame; and means for rotating a selected roller of the plurality of rollers;

ground engaging means on the base; and an elongated cleaning head extending along the lower frame member at the front edge of the rectangular base, said cleaning head comprising a pair of mutually opposed brushes, and means for removably securing the brushes to the frame;

whereby a floor covering is passed between said mutually opposed brushes when said floor covering is returned to storage upon said selected roller by operating the means for rotating in order to clean the floor covering as it is being retrieved from the floor for storage.

2. A floor covering rack as claimed in claim 1 wherein the ground engaging means comprises wheels and means is provided for preventing rotation of said wheels during retrieval of the floor covering.

3. A floor covering rack as claimed in claim 1 wherein the first and second upright sides are substantially triangular include bearings to support said rollers.

4. A rack for use in retrieving, cleaning and storing floor covering for temporarily covering a floor to be protected, said rack comprising:

a frame having a rectangular base including two side edges, a front edge, and a rear edge; and a lower frame member respectively at the front edge; and a respective first and second upright sides secured each side edge of the base, the first and second upright sides being joined at an upper end of said first and second upright sides by an top rail member; and a plurality of rollers rotatably mounted between the first and second upright sides in a vertically spaced, parallel relationship above the front and rear edges of the frame; and means for rotating a selected roller of the plurality of rollers;

ground engaging means on the base; and an elongated cleaning head extending along the lower frame member at the front edge of the rectangular base, said cleaning head comprising a cleaning material on a pair of mutually opposed cleaning material supports, and means for removably securing the cleaning material supports to the frame:

whereby a floor covering is passed through said cleaning head when said floor covering is returned to storage upon said selected roller by operating the means for rotating in order to clean the floor covering as it is being retrieved from the floor for storage.

5. A rack as claimed in claim 4 wherein said cleaning material comprises strands of yarn.

* * * * *